United States Patent [19]

Kitamura

[11] Patent Number: 4,528,561

[45] Date of Patent: Jul. 9, 1985

[54] INFORMATION OUTPUT DEVICE FOR RECORDING INFORMATION WITH VARIED RESOLUTION

[75] Inventor: Takashi Kitamura, Yokohama, Japan

[73] Assignee: Canon Kabushiki Kaisha, Tokyo, Japan

[21] Appl. No.: 288,785

[22] Filed: Jul. 31, 1981

[30] Foreign Application Priority Data

Aug. 11, 1980 [JP] Japan ..... 55-110005

[51] Int. Cl.[3] ..... G09G 1/16

[52] U.S. Cl. ..... 340/745; 340/728; 340/721

[58] Field of Search ..... 340/728, 731, 721, 745, 340/747

[56] References Cited

U.S. PATENT DOCUMENTS 3,967,268 6/1976 Roberts ..... 340/745

4,242,678 12/1980 Somerville ..... 340/728

4,408,197 10/1983 Komatsu et al. ..... 340/723

*Primary Examiner*—Marshall M. Curtis

*Attorney, Agent, or Firm*—Fitzpatrick, Cella, Harper & Scinto

[57] ABSTRACT

An information output device constructed with a storing device which stores therein information code signals and instruction signals, a first pattern generator which generates a pattern in the first density, a second pattern generator which generates a pattern in the second density, a reader which reads out the information code signal and instruction signal from the storing device, a device to apply the information code signal to the first pattern generator and sequentially read out the same with the first frequency, when the instruction signal read out of the reading device instructs the first density, and to apply the information code signal to the second pattern generator and sequentially read out the same with the second frequecy different from the first frequency, when the instructions signal instructs the second density, and an output device which produces an output pattern read out of the applying and reading device in the form of visible information.

5 Claims, 6 Drawing Figures

INFORMATION OUTPUT DEVICE FOR RECORDING INFORMATION WITH VARIED RESOLUTION

BACKGROUND OF THE INVENTION

1. Field of the Invention

This invention relates to an output device for information patterned by dots, which is capable of recording information with varied resolution when they are recorded on a recording medium.

2. Description of the Prior Art

An output device for producing a desired pattern of information by sequentially applying code signals of information such as characters, symbols, etc., to a pattern generator has been widely known.

However, since such a conventionally known information output device is provided with only a pattern generator, in which a dot pattern of a given density has been stored, it has difficulty in recording these characters and symbols with varied resolution.

SUMMARY OF THE INVENTION

It is an object of the present invention to provide an information output device capable of recording characters, symbols, etc., with varied resolution.

It is another object of the present invention to provide an information output device which is very simple in construction, and is capable of producing, with high resolution, those complicated characters, symbols, etc., as an output.

It is still another object of the present invention to provide an information output device capable of outputting characters, symbols, etc., with their resolution in vertical and horizontal rows being made different.

DETAILED DESCRIPTION OF THE PREFERRED EMBODIMENT

In the following, the present invention will be explained by detail in reference to the accompanying drawing showing one preferred embodiment of the present invention.

Figure 1:
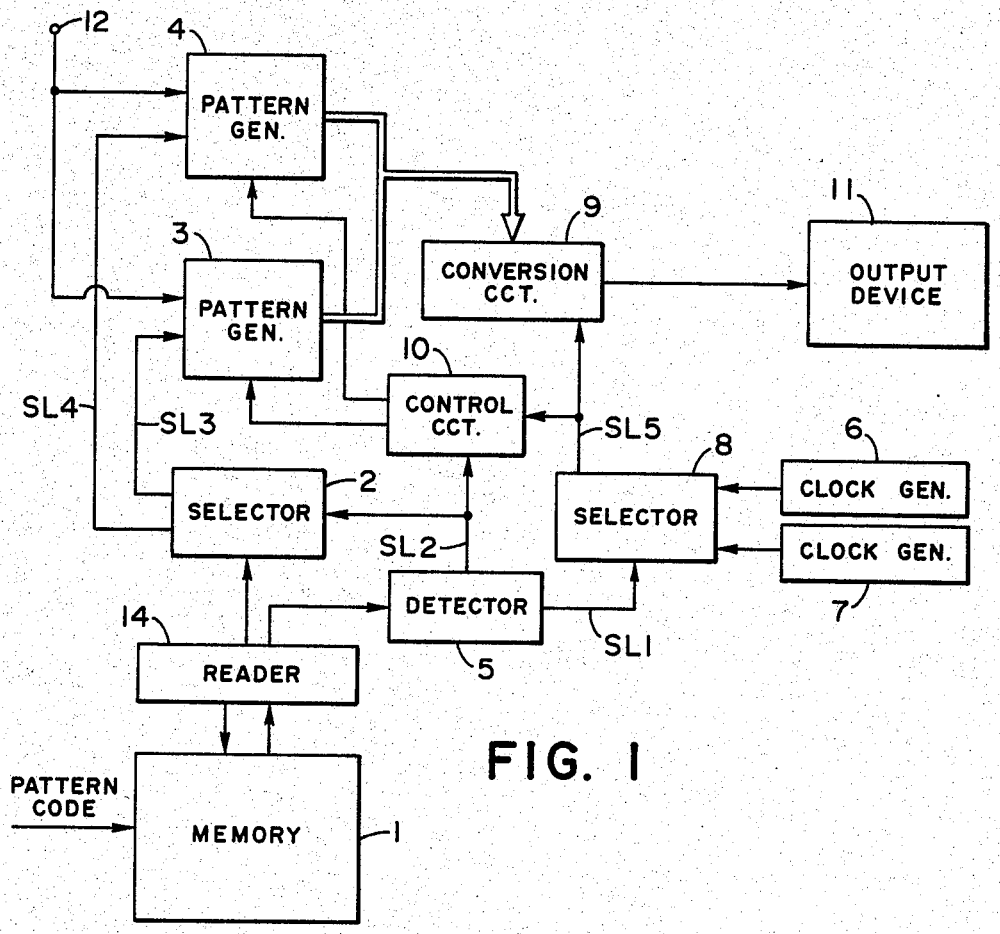
FIG. 1 is a block diagram showing the information output device according to the present invention.

Referring to FIG. 1, a reference numeral 1 designates a memory having a memory capacity of, for example, a single page of a sheet, and storing therein 8-bit code signals, for example, representing characters, symbols, etc., and 1-bit instruction signals to instruct whether these characters and symbols are to be recorded in a high density, or not.

Figure 2A:
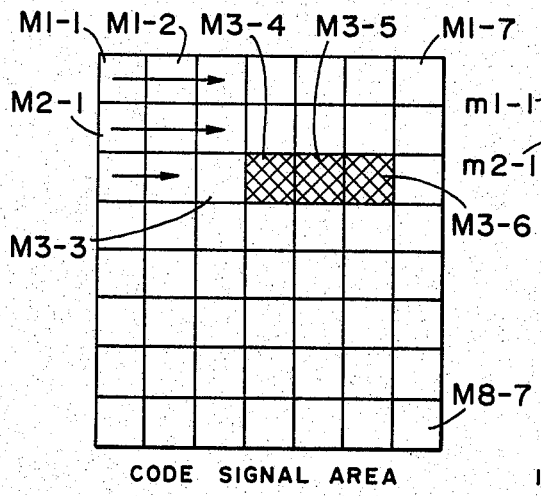
FIGS. 2A and 2B are a diagrams showing the stored contents in the memory of the information output device.
Figure 2B:
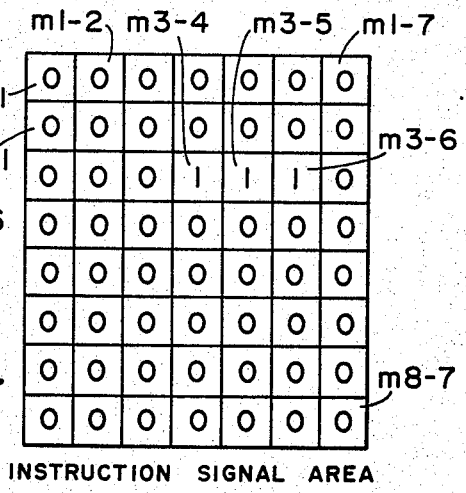

More detailed explanations of this memory will be given hereinbelow with reference to FIG. 2. The memory 1 (for the following sake of simplicity in the explanations, it is assumed that a single page consists of eight lines and each line contains seven characters) has a code signal area A and a code signal area B. A code signal consisting of 8 bits is stored in each of the code signal areas M1-1, M1-2, . . . , M8-7 in the code signal area A. Instruction signal areas m1-1, m1-2, . . . , m8-7 constituting the code signal area B correspond respectively to the abovementioned code signal areas in the area A, wherein those areas storing therein the code "0" are to instruct that the code signals in the corresponding areas be output as a pattern in an ordinary density, and those areas storing therein the code "1" are to instruct that the code signals in the corresponding areas be output as a pattern in a high density (high resolution). Therefore, in FIG. 2, the memory 1 indicates that the informations corresponding to the code signals stored in M3-4, M3-5 and M3-6 are to be output in a high density.

Turning back to FIG. 1, a reference numeral 14 designates a reader circuit to read out of the memory 1 those corresponding code signals and instruction signals, of which read signals the instruction signals are applied to a detector circuit 5. The detector circuit 5 differentiates whether the instruction signals are "0" or "1", a differentiated output of which is led out to signal lines SL1 and SL2. A numeral 2 refers to a selector circuit to be controlled by an output from the detector circuit. When the instruction signal is detected to be "1", the selector selects a signal line SL3 to apply a code signal obtained from the reader circuit 14 to a pattern generator 3. When the instruction signals is detected to be "0", the selector selects a signal line 4 to apply a code signal obtained from the reader circuit 14 to a pattern generator 4.

Figure 3C:
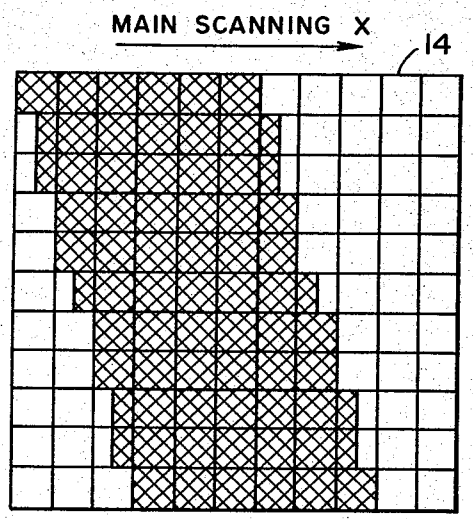
FIGS. 3A, 3B and 3C are front views showing the output patterns obtained by the information output device according to the present invention.
Figure 3B:
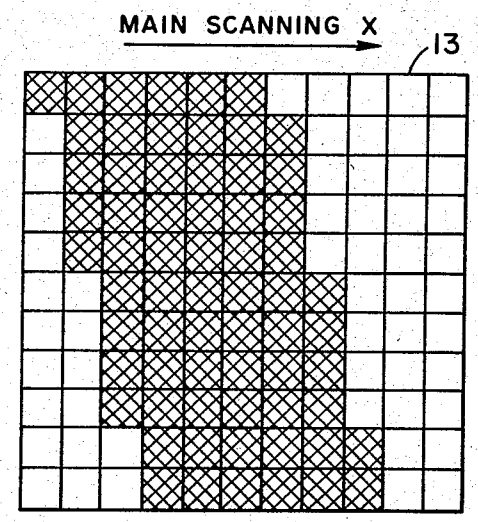

The pattern generator 4 is one which produces a pattern in an ordinary density, and stores therein a pattern formed with dots of $11\times11$ in both X and Y directions as shown in FIG. 3B, for example. The pattern generator 3 is one which produces a pattern in a high density, and stores therein a pattern formed with dots of $22\times11$ in the directions of X and Y, respectively, as shown in FIG. 3C, for example (a pattern, wherein the density in the main scanning direction is twice as high as that in the sub-scanning direction).

Figure 3A:
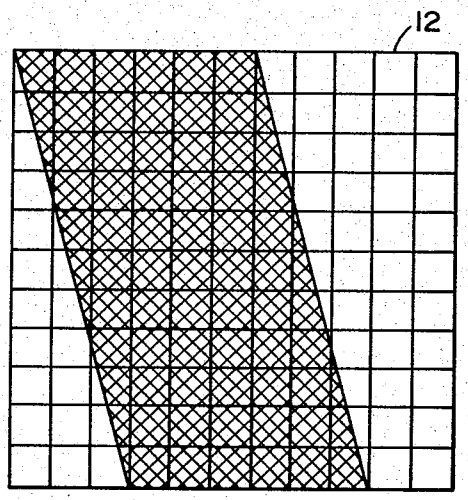

FIG. 3A shows an ideal output pattern, which can be approximated fairly well by doubling the density in the main scanning direction as shown in FIG. 3C.

Referring back again to FIG. 1, a numeral 6 refers to a clock signal generating circuit which generates a clock signal of frequency f. A numeral 7 also refers to a clock signal generating circuit which generates a clock signal of a frequency of 2f. Either one of the outputs from the clock signal generating circuits 6, 7 is selected by a selector circuit 8 to be led out to a signal line SL5. Explaining in more detail, when the detector circuit 5 detects the instruction signal "1", the clock signal of the frequency 2f in the clock signal generating circuit 7 is led out to the signal line SL5, and, when the detector circuit 5 detects the instruction signal "0", the clock signal of the frequency f in the clock signal generating circuit 6 is also led out to the signal line SL5.

The clock signal on the signal line SL5 is applied to either pattern generator 3 or 4 through a control circuit 10. The clock signal is so controlled in the control circuit that, when the detector circuit 5 detects the instruction signal to be "1", the clock signal of the frequency 2f is applied to the pattern generator 3, and, when the detector circuit 5 detects the instruction signal to be "0", the clock signal of the frequency f is applied to the pattern generator 4.

While the pattern generators 3, 4 store therein the patterns as shown in FIGS. 3C and 3B as mentioned above, these generators, by applying thereto the code signal and a signal indicating a row that is desired to be read out (the signal being at a position in the Y direction, and applied from the terminal 12 in FIG. 1), generate in parallel the dot signal in the X direction corresponding to that row (in the embodiment shown in FIG. 3, 11 dots or 22 dots). This parallel dot signal is input, in parallel, into a conversion circuit 9 consisting, for example, of a shift register, and sequentially read out dot by dot with a clock signal to be applied from the signal line SL5.

The dot signal can be output from an output device 11 in the form of visible information by its being used as a recording signal for the recording device such as, for example, a display device consisting of CRT, a laser beam recording device, and so forth.

Explaining further the operation of the information output device of the above-described construction, if the code signal areas M3-3 and m3-3 in the memory 1 are now being read out by the reader circuit 14 where a character code signal corresponding to an alphabet "A" is stored, the detector circuit 5 reads out the instruction signal "0" of the area m3-3, and leads the clock signal from the clock signal generating circuit 6 onto the signal line SL5. The result of this detection is applied to the control circuit 10 and the selector circuit 2, whereby the clock signal of the frequency f is applied to the pattern generator 4 and, at the same time, the character code signal of "A" is applied to the same pattern generator 4. As the consequence of this, 11-dot-signal at a certain position (e.g., the first row) in the Y direction of the dot pattern constructed with $11\times11$ dots is applied, in parallel, to the conversion circuit 9, and the dot signal is read out of the conversion circuit 9 in synchronism with the clock signal of the frequency f which has been applied to the conversion circuit as the shift pulse, whereby the character "A" in the first row is recorded by the output device as the 11-dot pattern.

In the next place, it is assumed that the code signal areas M3-4 and m3-4 in the memory 1 are read out by the reader circuit 14, and code signals corresponding to the pattern as shown in FIG. 3C, for example, are stored in the memory. The detector circuit 5 detects the instruction signal "1" of the area m3-4 to lead out the clock signal of the frequency 2f in the clock signal generating circuit 7 to the signal line 5, which clock signal is applied to the pattern generator 3. In the meantime, the selector circuit 2 is controlled by an output from the detector circuit 5 to thereby apply the code signal as read out to the pattern generator 3. Accordingly, 22-dot signals for the first line of the pattern as shown in FIG. 3C, for example, are output, in parallel, into the conversion circuit 9 from the pattern generator 3, and the dot signals in this conversion circuit 9 are read out with the clock signal of the frequency 2f and recorded by the output device.

Although, in the above-described embodiment, the density in the X direction of the pattern in the pattern generator 3 has been taken twice as high as the density in the X direction of the pattern in the pattern generator 4, the present invention is not limited to such integral multiple, but any arbitrary number N or 1/N (where N is an integer of more than 2) can be selected. In this case, it becomes necessary that the frequency of the clock signal from the clock signal generator 7 be made Nf or f/N.

The information output device of the present invention, as described in the foregoing, can easily alter the dot density for each character and symbol, produce character and symbol outputs of high quality, and can to prepare only those informations which are required to be recorded in a high quality pattern, with the consequence that the memory capacity may be small, and various other advantages are achieved.

What I claim is:

1. An information output device, comprising:

(a) input means for inputting in said device an information signal representing dot patterns to be output, and an instruction signal for instructing which of the dot patterns should be output in a first resolution for a first area of one image field and in a second resolution different from the first resolution for a second area of the same image field;

(b) first pattern generating means for generating a first dot pattern in the first resolution by applying the information signal thereto, said first dot pattern corresponding to the information signal as applied;

(c) second pattern generating means for generating a second dot pattern in the second resolution by applying the information signal thereto, said second dot pattern corresponding to the information signal as applied;

(d) means for applying the information signal to said first pattern generating means when the instruction signal instructs the first resolution, and for applying the information signal to said second pattern generating means when the instruction signal instructs the second resolution; and (e) circuit means for receiving the first and second dot patterns from said first and second pattern generating means and for outputting a received dot pattern as a plurality of lines, each of which lines is output sequentially at first and second rates for the first and second dot patterns, respectively, to be able to form dot patterns with different resolutions in the same image field.

2. The device as set forth in claim 1, wherein said first pattern generating means includes pattern generating means having a matrix of $(m\times n)$, and said second pattern generating means includes pattern generating means having a matrix of $(2m\times n)$.

3. The device as set forth in claim 1, wherein said instruction signal consists of 1 bit.

4. The device as set forth in claim 1, further comprising means for generating clock signals to sequentially output the lines from said circuit means, said clock signal generating means being adapted to generate clock signals having different frequencies in accordance with the instruction signal.

5. The device as set forth in claim 1, wherein said input means includes means for storing the information signal and the instruction signal.

* * * * *